US005772452A

United States Patent [19]

Aoyama

[11] Patent Number: 5,772,452

[45] Date of Patent: Jun. 30, 1998

[54] CONNECTOR FOR A CIRCUIT BOARD

[75] Inventor: Masahiko Aoyama, Yokkaichi, Japan

[73] Assignee: Sumitomo Wiring Systems, Ltd., Japan

[21] Appl. No.: 653,286

[22] Filed: May 24, 1996

[30] Foreign Application Priority Data

May 31, 1995 [JP] Japan ..... 7-158347

[51] Int. Cl.[6] ..... H01R 9/09

[52] U.S. Cl. ..... 439/74; 439/79

[58] Field of Search ..... 439/74, 79, 80, 439/76.1; 361/685

[56] References Cited

U.S. PATENT DOCUMENTS

| | | | |
|---|---|---|---|
| 3,147,402 | 9/1964 | Hochstetler | 439/79 |
| 3,443,160 | 5/1969 | Salera | 361/736 |
| 4,689,721 | 8/1987 | Damerow | 439/67 |
| 4,714,442 | 12/1987 | Walkup | 439/844 |
| 4,723,196 | 2/1988 | Hofmeister et al. | 439/75 |
| 4,900,258 | 2/1990 | Hnatuck et al. | 439/79 |
| 5,040,994 | 8/1991 | Nakamoto et al. | 361/785 |
| 5,060,113 | 10/1991 | Jacobs | 439/75 |
| 5,190,461 | 3/1993 | Oorvi et al. | 439/74 |
| 5,211,586 | 5/1993 | Maue et al. | 439/79 |
| 5,636,999 | 6/1997 | Hirai et al. | 439/79 |
| 5,647,749 | 7/1997 | Atoh et al. | 439/79 |

FOREIGN PATENT DOCUMENTS 4-99381 8/1992 Japan .

*Primary Examiner*—Neil Abrams
*Attorney, Agent, or Firm*—Anthony J. Casella; Gerald E. Hespos; Ludomir A. Budzyn

[57] ABSTRACT

The invention is designed to assemble a connector with circuit board(s) with an improved degree of freedom. Directly connectable terminal fittings 12 and housing side terminals 13 are mounted on a housing 11. The housing 11 is mounted on a main circuit board 40, and the directly connectable terminal fittings 12 are inserted into through holes formed in the main circuit board 40 and soldered. An auxiliary circuit board 50 is disposed above the main circuit board 40 with the housing 11 therebetween. Board side terminals 14 mounted on the auxiliary circuit board 50 are connected with housing side terminals 13.

10 Claims, 9 Drawing Sheets

CONNECTOR FOR A CIRCUIT BOARD

BACKGROUND OF THE INVENTION

1. Field of the Invention

The present invention relates to a connector to be assembled with a circuit board.

2. Description of the Prior Art

The prior art includes connectors having a housing and terminal fittings pressed into and retained in the housing. One end of each terminal fitting projects into the housing and is brought into contact with a mating terminal when the connector is engaged with a mating connector. The other end of each terminal fitting is bent in L-shape. These other ends are inserted into terminal insertion holes formed in a circuit board when the housing is mounted on the circuit board, and then are soldered with the circuit board.

With the prior art connector, the terminal fittings carried by the housing are directly soldered with the circuit board on which the housing is mounted. Accordingly, it is impossible to detach the housing from the circuit board while leaving the portions soldered with the circuit board and/or to connect the terminals of the connector with another circuit board which is different from the one on which the housing is mounted. Thus, this connector can be used with a low degree of freedom.

For example, when an electronic device is fabricated by mounting the connector of this type on a printed circuit board, another printed circuit board may be disposed above the printed circuit board mounted with the connector so that the connector is located between two printed circuit boards. In such a case, the terminals carried by the housing of the prior art connector cannot be directly connected with the upper circuit board. Accordingly, the terminals of the connector have to be connected with the upper circuit board by connecting the upper and lower circuit boards by means of a flat cables, a flexible printed circuit or like jumpers. This leads to an undesired increase in the number of circuits established by jumpers and an increased probability of picking up noises.

In view of the above problems, an object of the invention is to provide a connector for a circuit board which can be mounted on the circuit board with an improved degree of freedom.

SUMMARY OF THE INVENTION

According to the invention there is provided a connector for a circuit board, comprising: a housing, and at least one terminal fitting being connectable with a first circuit board. The terminal fitting comprises a housing side terminal secured on the housing and a board side terminal connectable with the first circuit board. The housing side terminal and the board side terminal are detachably connected with each other as the housing and the first circuit board are mounted.

According to a preferred embodiment of the invention, the housing side terminal and/or the board side terminal is provided with engaging means for the detachable connection. The engaging means preferably comprises male and female connection portions and/or a connecting portion having a blade-shape and a connecting portion comprising a slot.

Preferably, there is further provided at least one auxiliary board side terminal which is connectable with a second or an auxiliary circuit board. The second board side terminal may be fixedly connected with the second circuit board.

Preferably the connector further comprises a holding means for holding the board side terminals in a predetermined orientation. The holding means preferably comprises a holding plate arranged between the first circuit board and the housing or at least partially fitted or arranged in a recess of the housing in an assembled state of the connector. The holding means most preferably comprises at least one positioning slot and/or at least one positioning hole.

According to a further preferred embodiment, the housing is mountable on the first circuit board and/or on the second circuit board. The housing may comprise two or more housing parts.

The board side terminal and/or the auxiliary board side terminal are engagingly fitted in or integrally formed with the housing.

According to a further aspect of the invention, the object is solved according to the invention by a connector for at least two circuit boards, comprising a housing having at least two separable housing parts, and at least one terminal fitting provided in each of the two housing parts and being connectable with a first circuit board and a second circuit board. One of the two housing parts is fixedly mountable on the first board and the other is fixedly mountable on the second board. The two housing parts are joinable such that a single mating connector can be connected simultaneously to the two housing parts.

According to a preferred embodiment of the invention there is provided a connector for a circuit board, comprising a housing mountable on the circuit board, and terminal fittings mounted on the housing which are connectable with the circuit board. The terminal fittings each comprise a housing side terminal secured on the housing and a board side terminal to be connected with the circuit board. The housing side terminals and the board side terminals are connected with each other as the housing is mounted on the circuit board.

Before the above connector is assembled with the circuit board, the board side terminals are mounted on the circuit board. As the housing carrying the housing side terminals is assembled with the circuit board, the board side terminals and the housing side terminals are electrically connected.

As described above, as the housing is assembled with the circuit board, the board side terminals and the housing side terminals are electrically connected. Accordingly, the housing can be easily detached from the circuit board, leaving the soldered portions, or the terminals of the connector can be easily connected with another circuit board different from the one on which the housing is mounted. Thus, the connector can be used with an improved degree of freedom.

Further preferably, there is provided a connector for a circuit board, comprising a housing mountable on the circuit board, terminal fittings mounted on the housing which are connectable with the circuit board, housing side terminals secured on the housing, and board side terminals which are connectable with another circuit board different from said circuit board and are connected with the housing side terminals as the housing is mounted on the circuit board.

When the above connector is to be assembled with the circuit boards, the housing is mounted on one circuit board and the terminal fittings mounted on the housing are connected with this circuit board. The board side terminals are mounted on another circuit board. When the housing is assembled with the other circuit board, the board side terminals mounted on the other circuit board and the housing side terminals mounted on the housing are connected with each other, with the result that the connector can be connected with both circuit boards.

The connector may further comprise a holder for holding the board side terminals in such an alignment as they are mounted on the circuit board.

Accordingly, the board side terminals are held in advance by the holder in such an alignment as they are to be mounted on the circuit board. The connector is assembled with the circuit board in this state.

Particularly, since the board side terminals are positioned by the holder, they can be easily and securely mounted on the circuit board.

Preferably, the holder plate is tightly held between the circuit board and the connector in an assembled state of the connector and the circuit board.

Accordingly, the holder is tightly held between the circuit board and the connector when the circuit board and the connector are assembled, with the result that the circuit board and the connector are made integral to each other via the holder.

Further, since the circuit board and the connector are made integral to each other via the holder, they can stably remain assembled.

DETAILED DESCRIPTION OF THE PREFERRED EMBODIMENTS

Figure 1:
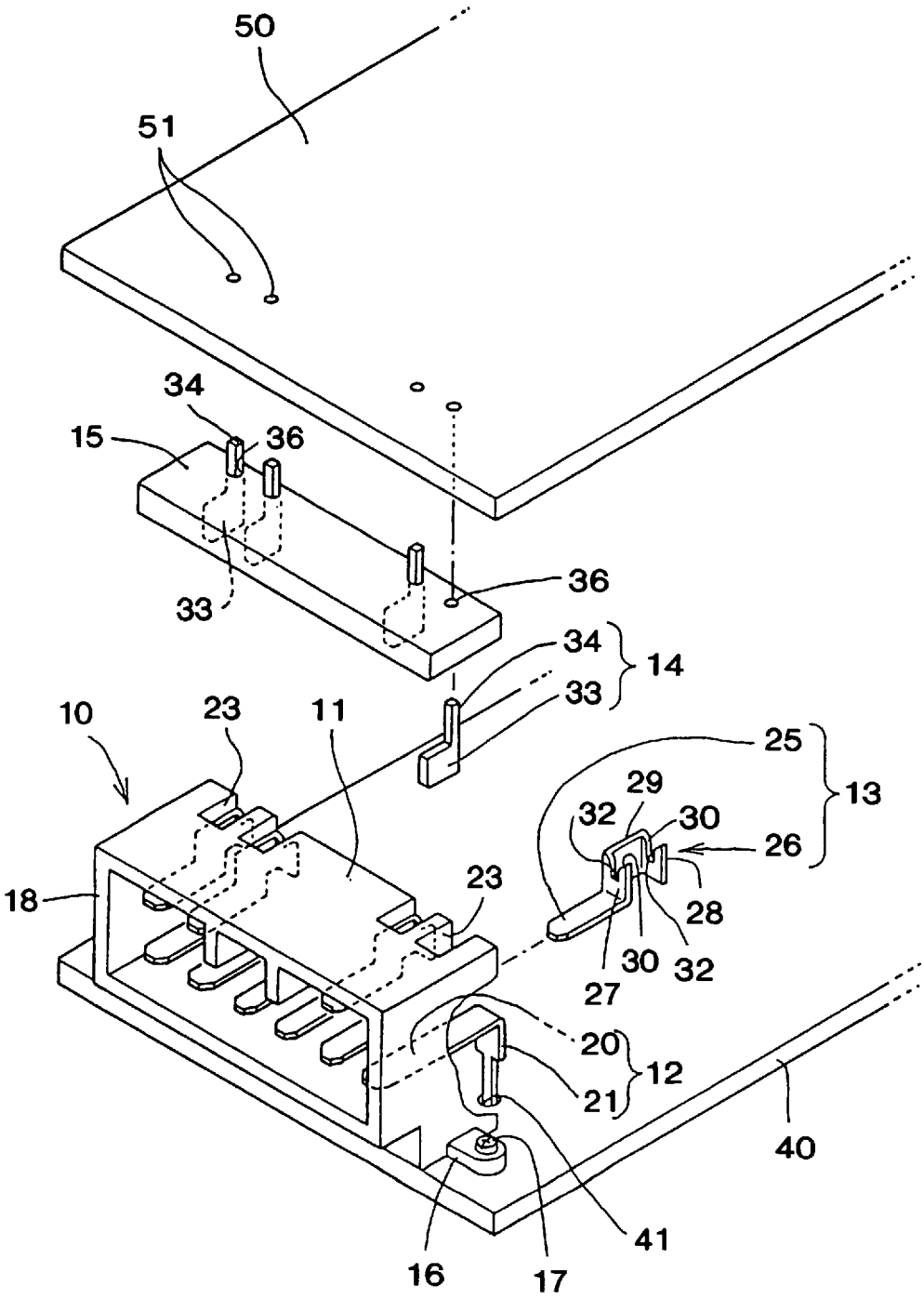
FIG. 1 is a partly exploded perspective view showing a state where a connector according to one embodiment of the invention is separated from one circuit board.
Figure 2:
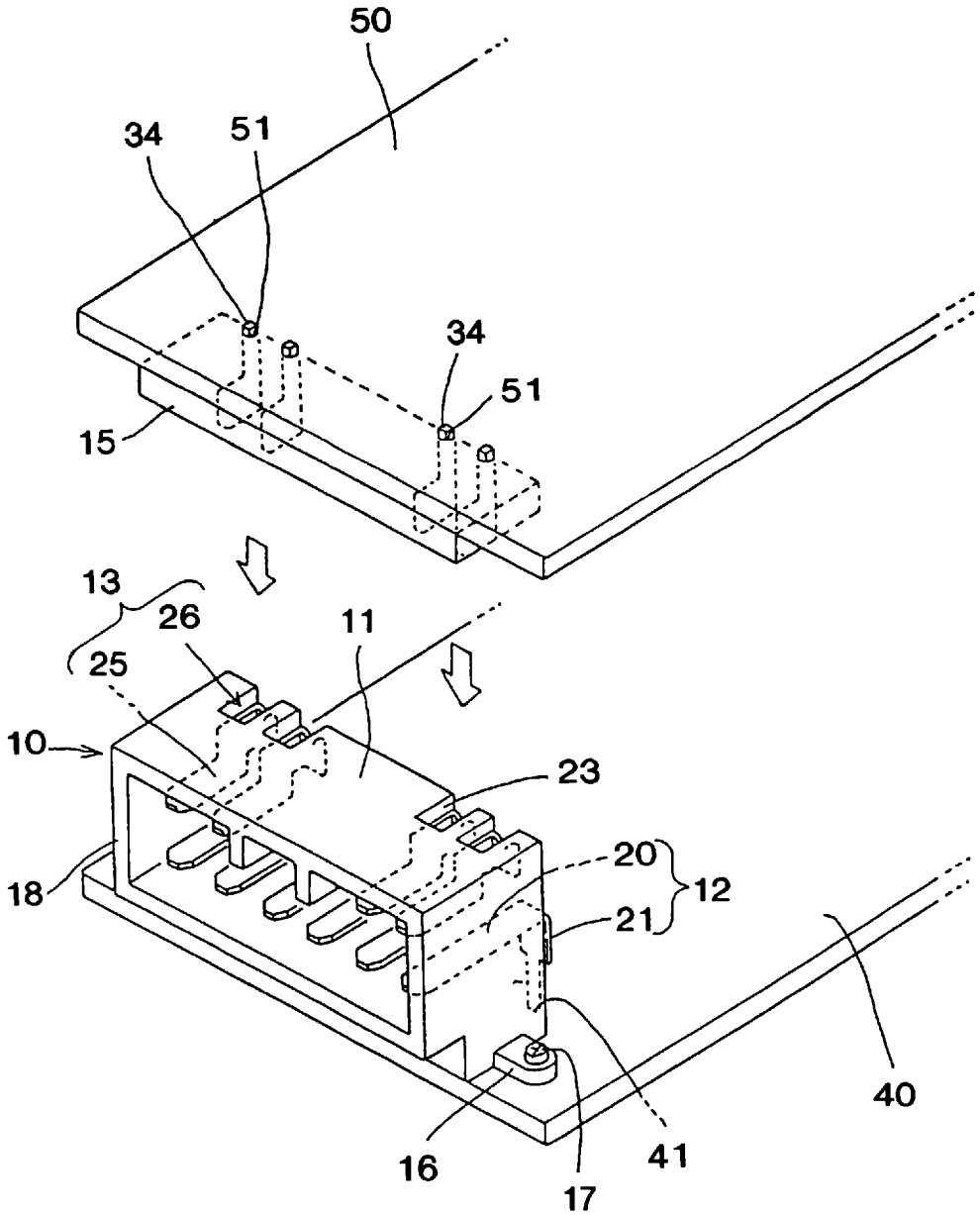
FIG. 2 is a perspective view showing a state where the connector is mounted on a main circuit board.
Figure 3:
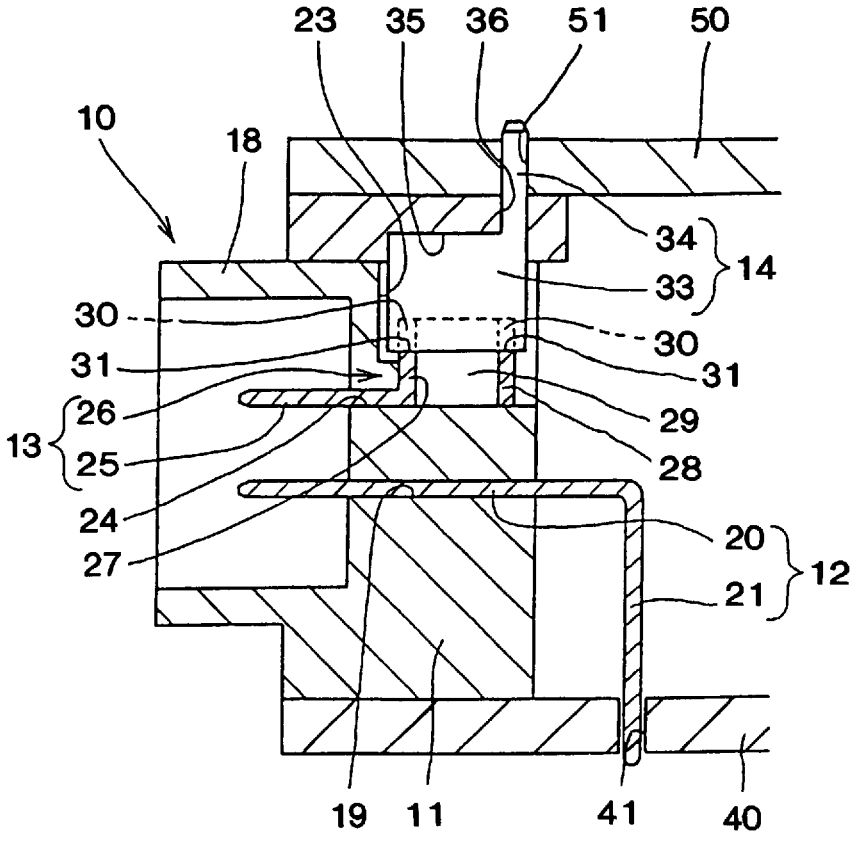
FIG. 3 is a section of an assembly of the connector and the circuit boards, FIG. 4 (*a*) is a perspective view of a second embodiment showing a state where the connector is mounted on a main circuit board, FIG. 4 (*b*) is a section of an assembly of the connector shown in FIG. 4 (*a*)

A connector 10 for a circuit board according to the invention is connected both with a main circuit board 40, which is the lower circuit board in FIGS. 1 to 3, and with an auxiliary circuit board 50 which is the upper circuit board in FIGS. 1 to 3. The connector 10 includes a housing 11 secured on the main circuit board 40, terminal fittings 12 directly connected with the main circuit board 40, housing side terminals 13 and board side terminals 14 to be connected with the auxiliary circuit board 50, and a holder or holding means or holding plate or positioning means 15 disposed between the housing 11 and the auxiliary circuit board 50.

The housing 11 includes a pair of mount portions 16 each projecting outward from the bottom ends of its lateral side walls and formed with a positioning hole (not shown). The mount portions 16 are flush with the bottom surface of the housing 11. The housing 11 is secured on the main circuit board 40 by a known means, e.g. by spirally fitting screws 17 inserted into the positioning holes into screw holes (not shown) formed in the main circuit board 40.

The housing 11 is formed with a hood 18 having an opening at its front. A mating female housing is fittable into the hood 18. A plurality of terminal fitting mount holes 19 (six in this embodiment) are formed side by side in the lateral direction of the housing 11, in particular in positions below the middle height thereof. The mount holes 19 extend from the rear end surface of the hood 18 to the rear end surface of the housing 11. Directly connectable terminal fittings 12 are pressed into the respective mount holes 19 in the housing 11. Each terminal fitting 12 has a known L-shaped structure including a tab 20 extending toward the opening of the hood 18 and a board connection portion 21 extending downward from the rear end of the tab 20 behind the housing 11. The tab 20 is engageable with a female terminal fitting (not shown) of a mating connector. When the housing 11 is mounted on the main circuit board 40, the leading end of the board connection portion 21 is inserted into a corresponding through hole 41 formed in the main circuit board 40 and then connected, e.g. soldered.

The housing 11 is also formed with a plurality of cavities 23 (four in this embodiment) opening and extending over the upper and rear surfaces of the housing 11 above the terminal fitting mount holes 19, and terminal fitting mount holes 24 extending from the front end surface of the respective cavities 23 to the rear end surface of the hood 18. A housing side terminal 13 used to connect the auxiliary circuit board 50 is mounted in each cavity 23.

The housing side terminal 13 is formed by bending a metal plate of a specified shape, and includes a horizontally extending tab 25 and a connection portion 26 continuous or integrally connected with the rear end of the tab 25. The connection portion 26 includes a front plate 27, a rear plate 28 and a side plate 29 connecting the front and rear plates 27 and 28, and is U-shaped when viewed from above. The front and rear plates 27 and 28 of the connection portion 26 are formed with guide portions 30 defined by opposite walls which widen toward their upper ends, and engaging slots 32 continuous with the lower ends of the corresponding guide portions 30. The width of the slots 31 is set slightly smaller than the thickness of a connection portion 32 of a board side terminal 14.

The housing side terminals 13 are integrally mounted on the housing 11 by pressing the tabs 25 into the mount holes 24. The front portions of the tabs 25 of the terminals 13 mounted on the housing 11 extend into the hood 18 in parallel with the tabs 20 of the terminal fittings 12 so as to be engageable with female terminal fittings (not shown) of the mating connector. The connection portions 26 are positioned in the corresponding cavities 23, and the guide portions 30 are aligned with the openings of the cavities 23 in the upper surface of the housing 11 so as to be ready to receive the board side terminals 14 to be described later.

The board side terminals 14 are adapted to connect the housing side terminals 13 and the auxiliary circuit board 50. Each board terminal 14 is made of a metal plate having a specified thickness, and includes a rectangular connection portion 33 engageable with the connection portion 26 of the housing side terminal 13, and a mount pin 34 projecting upward from the upper rear edge of the connection portion 33. The lower end of the connection portion 33 can be pressed into the engaging slots 31 of the connection portion 26 of the housing side terminal 13. Similar to the terminal fittings 12, the mount pins 34 are inserted into corresponding through holes 51 formed in the auxiliary circuit board 50 and e.g. soldered to be connected with a circuit (not shown) of the circuit board 50. The board side terminals 14 are mounted on the auxiliary circuit board 50 before the connector 10 is assembled with the auxiliary circuit board 50.

The holder 15 disposed between the housing 11 and the auxiliary circuit board 50 is made of a nonconductive material and has a width substantially same as that of the housing 11 and a specified thickness. The holder 15 is formed with a plurality of positioning slots 35 and a plurality of positioning holes 36 (four each in this embodiment). The positioning slots 35 are formed by cutting away the lower surface of the holder 15 so as to be engageable with the upper edges of the connection portions 33 of the corresponding board side terminals 14. The positioning holes 36 are through holes vertically extending at the rear ends of the positioning slots 35. The mount pins 34 of the housing side terminals 13 are inserted into the positioning holes 36. The positioning slots and holes 35 and 36 are aligned with the housing side terminals 13 mounted in the housing 11. Further, the alignment of the positioning holes 36 are same as that of the through holes 51 formed in the auxiliary circuit board 50.

The board side terminals 14 are mounted on the holder 15 before being mounted on the auxiliary circuit board 50. The board side terminals 14 are mounted on the holder 15 by pressing the mount pins 34 into the positioning holes 36 from below and pressing the upper edges of the connection portions 33 into the positioning slots 35. With the terminals 14 mounted on the holder 15, the upper ends of the mount pins 34 project upward from the holder 15 by a distance longer than the thickness of the auxiliary circuit board 50, and the connection portions 33 project downward therefrom by a distance sufficient to be fitted into the engaging slots 31 of the housing side terminals 13.

Next, how the connector 10 of this embodiment is mounted on the circuit boards 40 and 50 is described.

After the board side terminals 14 are integrally or unitarily mounted on the holder 15, this integral assembly is assembled with the auxiliary circuit board 50. With the terminals 14 mounted on the holder 15, the four mount pins 34 project from the holder 15 in parallel to one another and are so positioned as to be in alignment with the through holes 51 of the auxiliary circuit board 50. Accordingly, when the integral assembly is mounted on the auxiliary circuit board 50, the four mount pins 34 are simultaneously insertable into the through holes 51. This facilitates the assembling operation. The mount pins 34 are deeply inserted into the through holes 51 until their upper ends project upward from the auxiliary circuit board 50, thereby bringing the holder 15 into close contact with the lower surface of the auxiliary circuit board 50. In this state, the mount pins 34 are secured and/or connected on the auxiliary circuit board 50 e.g. by means of soldering (not shown), with the result that the holder 15, board side terminals 14 and auxiliary circuit board 50 are integrally assembled.

After the terminal fittings 12 and the housing side terminals 13 are mounted on the housing 11, the housing 11 is assembled with the main circuit board 40 in advance. When the connector 10 is mounted on the main circuit board 40, the leading ends of the terminal fittings 12 are positioned and inserted into the through hole 41 of the main circuit board 40, and the housing 11 is secured on the main circuit board 40 by the screws 17. In this way, the connector 10 is completely mounted on the main circuit board 40, with the result that the terminal fittings 12 arranged at the lower stage of the housing 11 are connected with the main circuit board 40.

Thereafter, the connector 10 is assembled with the auxiliary circuit board 50. During assembling, the auxiliary circuit board 50 is pressed against the connector 10 from above while the board and housing side terminals 14 and 13 are positioned with respect to each other. Then, the lower edges of the connection portions 33 of the board side terminals 14 are pressed into the engaging slots 31 by being guided by the tapered guide portions 30 of the housing side terminals 13, thereby completing the assembling. At this stage, the lower and upper surfaces of the holder 15 are in close contact with the upper surface of the housing 11 and the lower surface of the auxiliary circuit board 50, respectively. In this way, the housing 11 is assembled with the auxiliary circuit board 50 and the housing side terminals 13 arranged at the upper stage of the housing 11 are connected with the auxiliary circuit board 50 via the board side terminals 14.

It should be appreciated that the main circuit board 40 is secured by screws on a mount portion formed in a unit box (not shown) for housing the connector 10 and the main and auxiliary circuit boards 40 and 50, and that the auxiliary circuit board 50 is also secured on another mount portion in the unit box.

Since the tapered guide portions are formed in the housing side terminals 13, it is unnecessary or not indispensable to accurately position the connection portions 26, 33 with respect to each other in the lateral direction. Further, since the connection portions 26 of the housing side terminals 13 are hollow in their forward/backward direction, it is unnecessary to accurately position the connection portions 26, 33 with respect to each other in the forward/backward direction. Thus, the connection can be easily and securely made even if the engagement of the connection portions 26, 33 cannot be visually confirmed.

The terminal fittings mounted on the connector 10 are directly connected with the circuit of the auxiliary circuit board 50 without using a flat cable. This obviates the need for an operation of connecting a flat cable with the both circuit boards. In other words, a working efficiency is improved by reducing the number of necessary operations. If necessary, the main and auxiliary circuit boards 40 and 50 may be connected using a flat cable and a flexible printed circuit board as jumpers. Since the connector 10 is directly connected with the auxiliary circuit board 50 even in such a case, the number of circuits established by the jumpers can be reduced. Accordingly, by eliminating the jumper connection or reducing the number of circuits established thereby, a space for arranging the flat cable or flexible printed circuit board can be reduced. Consequently, the final assembly can be made smaller.

Since the connector 10 and the auxiliary circuit board 50 are connected by engagement of the connection portions 26 of the housing side terminals 13 and the connection portions 33 of the board side terminals 14, they can be easily separated. Accordingly, if either one of the connector 10 and the auxiliary circuit board 50 experiences an abnormality, these two elements are separated, and only the element experiencing an abnormality is replaced while the remaining normal element still remains in use. Thus, a maintenance cost can be reduced. Further, if there are prepared, e.g. a plurality of kinds of auxiliary circuit boards 50 having different functions, the function of the device can be changed only by changing the auxiliary circuit board 50. Thus, a multitude of kinds of devices can be manufactured while using as many parts as possible in common.

Further, in this embodiment, since the holder 15 is closely held between the connector 10 and the auxiliary circuit board 50, the connector 10 and the auxiliary circuit board 50 do not move toward each other even if an upward or downward acting external force is exerted on them. Accordingly, the connected portions of the board side terminals 14 with the auxiliary circuit board 50 and the engaged portions of the housing side terminals 13 and the board side terminals 14 are not damaged due to the movement of the connector 10 and the auxiliary circuit board 50 with respect to each other. Therefore, these elements can remain properly connected and engaged.

The holder 15 also acts to position and align the mount pins 34 of the board side terminals 14 with respect to the through holes 51 of the auxiliary circuit board 50. Thus, the board side terminals 14 can be easily and securely connected with the auxiliary circuit board 50.

The invention is not limited to the described and illustrated embodiment. For example, the following embodiments are embraced by a technical scope of the invention. Besides the following embodiments, the invention can be embodied in a variety of manners without departing from the spirit and scope of the invention as defined in the claims.

(1) Although the holder 15 is used in the foregoing embodiment, the board side terminals 14 may, according to the invention, be connected with the auxiliary circuit board 50 without using the holder 15.

(2) In the foregoing embodiment, the main circuit board 40 is connected with the connector 10 using the directly connectable terminal fittings 12 while the auxiliary circuit board 50 is connected therewith using the board side terminals 14 and the housing side terminals 13. However, according to the invention, both circuit boards 40, 50 may be connected with the connector 10 using the board side terminals 14 and the housing side terminals 13.

(3) In the foregoing embodiment, the board side terminals 14 and the housing side terminals 13 are pressingly engaged. However, according to the invention, a spring member may be provided in one or both of the terminals, and the terminals may be engaged taking advantage of an elastic force of the spring member.

(4) In the foregoing embodiment, the board side terminals 14 and the housing side terminals 13 have male and female connection portions, respectively. However, according to the invention, the shapes of the connection portions are not limited to the above. For example, the board side terminals 14 may have female connection portions while the housing side terminals 13 have male connection portions. Alternatively, the terminals 14 and 13 may have connection portions of other shapes.

(5) Although the connector 10 is assembled with two circuit boards 40, 50 in the foregoing embodiment, the invention is applicable to an assembly in which a connector is assembled with a single circuit board or more than two circuit boards.

(6) The numbers of the terminal fittings 12, 13 mounted on the connector 10 are not limited to those described in the foregoing embodiment. The invention is applicable to any connector for a circuit board on which any desired number of terminal fittings are mountable.

Figure 4A:
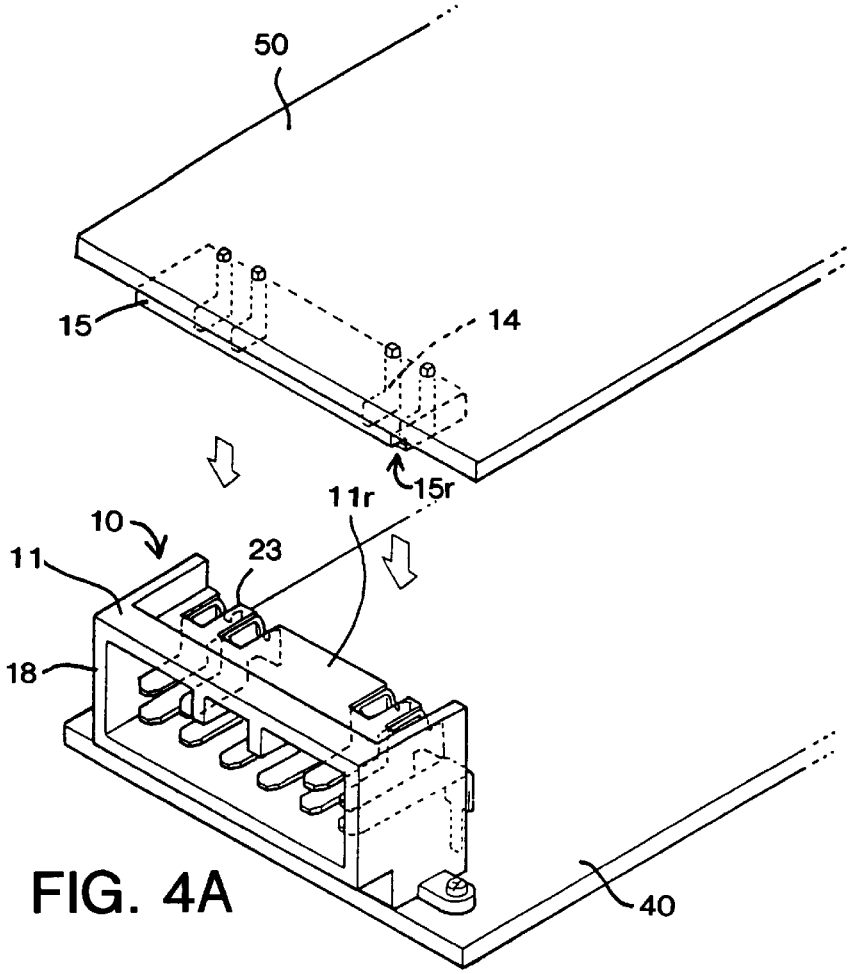
Figure 4B:
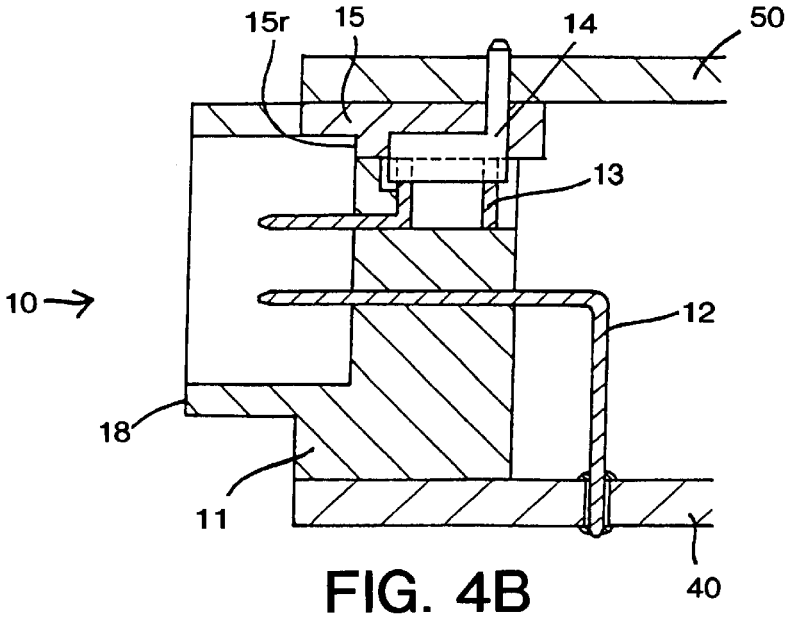

A second embodiment of the invention is described with reference to FIGS. 4 (*a*) and (*b*).

The second embodiment is similar to the first embodiment with the exception that the housing 11 is provided with a housing recess 11*r* for accommodating or fitting the holder 15 in or into the housing 11. Thus the auxiliary board 50 can be located more closely to the housing 11 whereby the volume of the whole connector can be reduced.

The holder 15 may be preferably provided with a holder recess 15*r* on the front portion thereof. When the holder 15 is located in or inside the housing recess 11r of the housing 11 as shown in FIG. 4 (*b*), the holder recess 15*r* flushes with the hood 18 thus allowing a good insertion of mating connectors into the connector 10.

Figure 5:
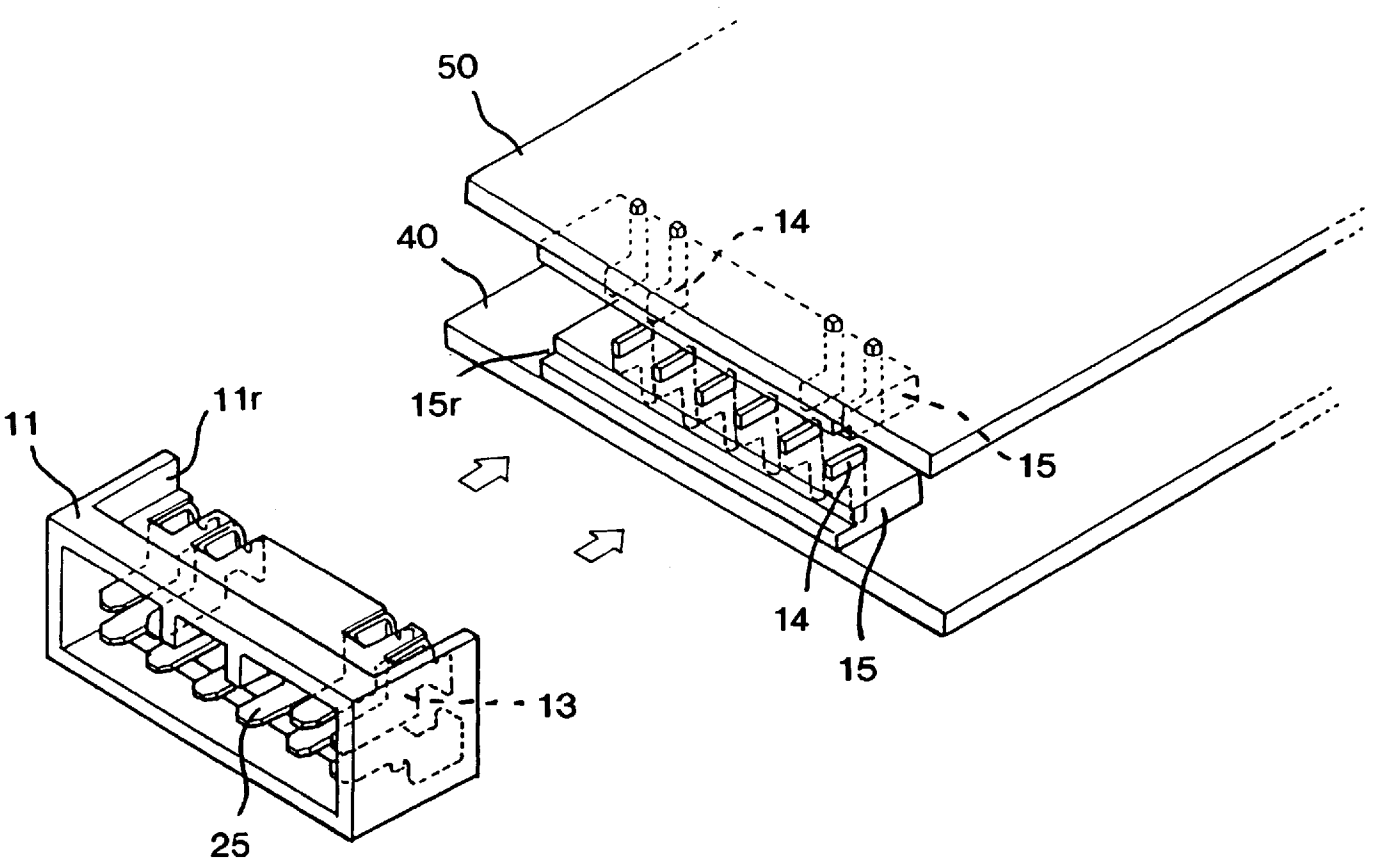
FIG. 5 is a perspective view of a third embodiment of the invention.

A third embodiment of the invention is described with reference to FIG. 5.

Board side terminals 14 are in particular fixedly mounted via holders 15 on the first or auxiliary board 40 and on the second or main board 50.

The housing 11 of the connector is provided with housing side terminals 13 being similar in construction to those of the preceding embodiments and allowing for an insertion of the connection portions of the mating board side terminals 14 from a longitudinal direction (i.e. the direction along the horizontally extending tab 25) and/or a lateral direction.

The housing 11 can be in particular laterally inserted between the first board 40 and the second board 50, thereby connecting the board side terminals 14 and the housing side terminals 13 and creating an electrical contact between them. The housing is preferably provided with two housing recesses 11*r* on the surfaces facing the holders 15 and the holders 15 are provided with holder recesses 15*r* in the front portion thereof in a similar way as in the second embodiment.

Figure 6:
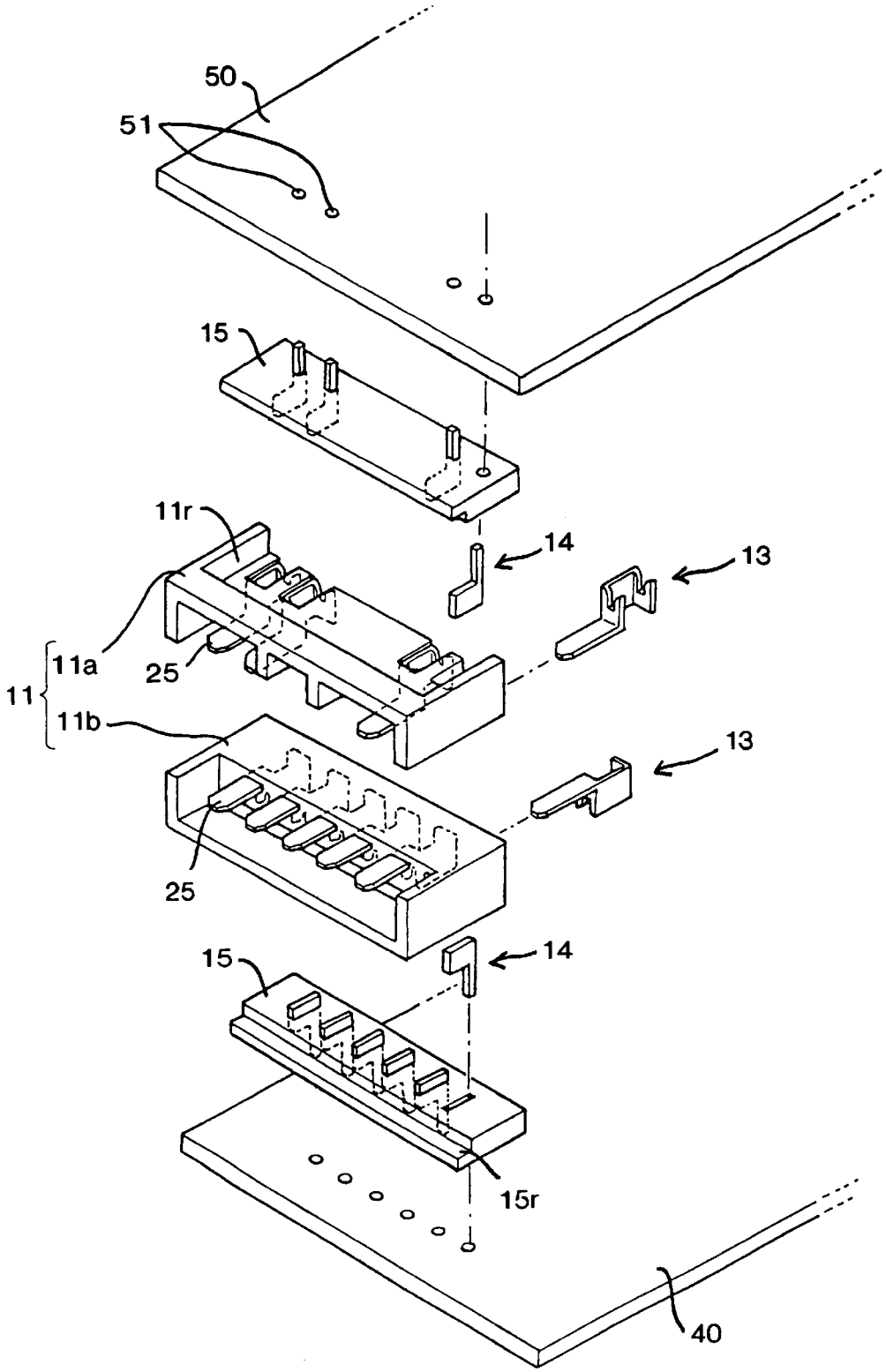
FIG. 6 is an exploded view of a fourth embodiment of the present invention.
Figure 7:
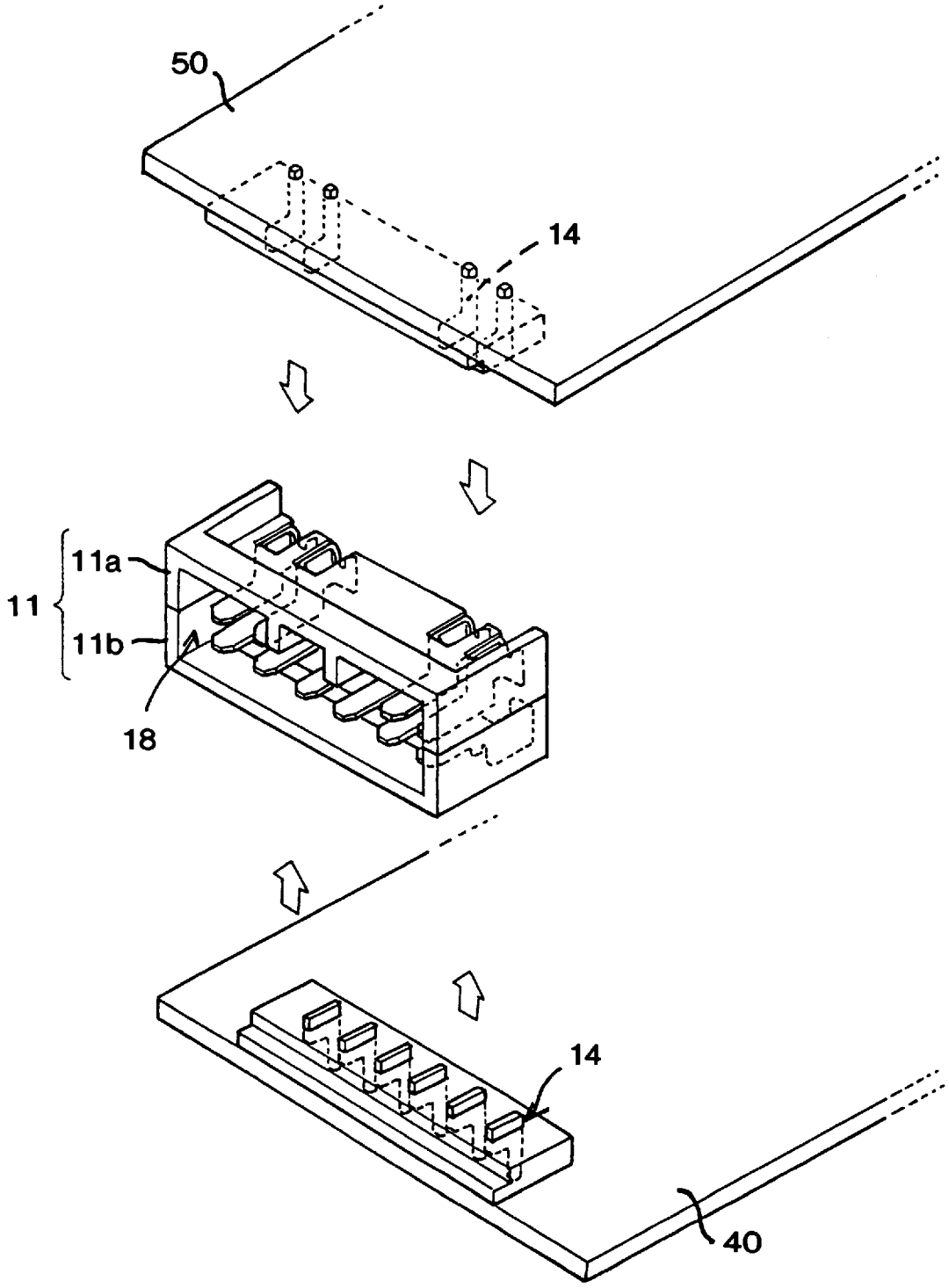
FIGS. 7 and 8 are perspectives view of the fourth embodiment shown in FIG. 6.

A fourth embodiment of the invention is described with reference to FIGS. 6 and 7.

The connector according to the fourth embodiment is similar to the connector according to the first embodiment shown in FIG. 1 with the exception that the housing 11 of the connector is divided in a first, in particular upper housing part 11*a* and a second, in particular lower housing part 11*b*.

The first housing part 11*a* and the second housing part 11*b* are provided with housing-side terminals 13, wherein the housing-side terminals 13 of the first housing part 11*a* and the housing-side terminals 13 of the second housing part 11*b* are oriented in a symmetric way with respect to the dividing line or plane of the two housing parts 11*a* and 11*b*. The housing parts 11*a* and 11*b* are in particular similar and can be provided with locking means (not shown) which may lock the two parts 11*a* and 11*b* together or joined.

When the two housing parts 11*a* and 11*b* are joined the horizontally extending tabs 25 of the housing-side terminals 13 of the housing parts 11*a* and 11*b* are spaced such, that female terminal fittings of a single mating connector (not shown) can be inserted or connected contemporarily from a front portion thereof. Furthermore the housing parts 11*a* and 11*b* are formed such that a hood 18 (see FIG. 7) similar to that of the preceding embodiments is formed between the in a joined state.

Figure 8:
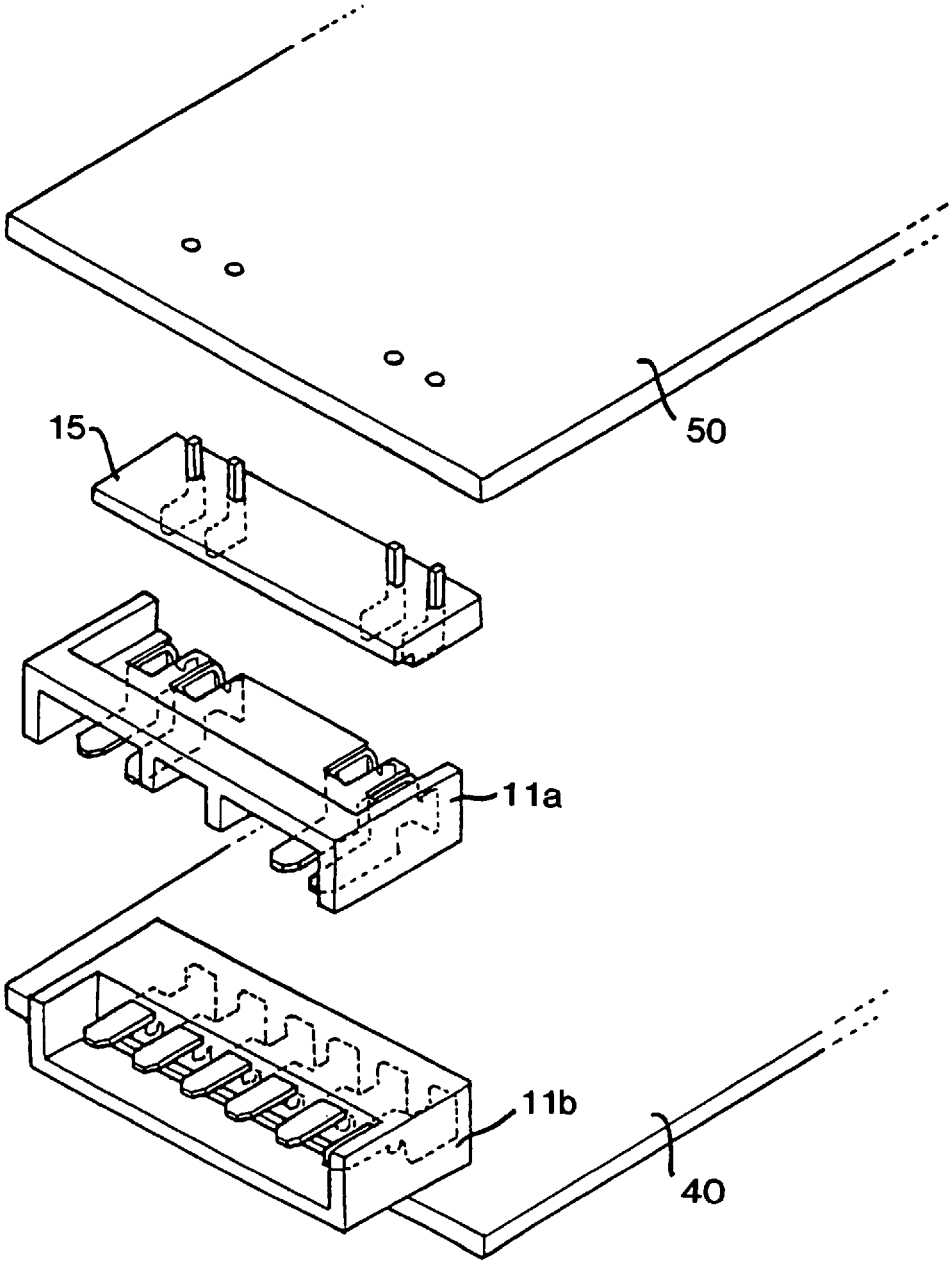

The housing parts 11*a* and 11*b* may be first joined and then connected with the respective first and second boards 50 and 40 (FIG. 7) or first connected to the respective boards 50 and 40 and then joined together (FIG. 8).

Figure 9:
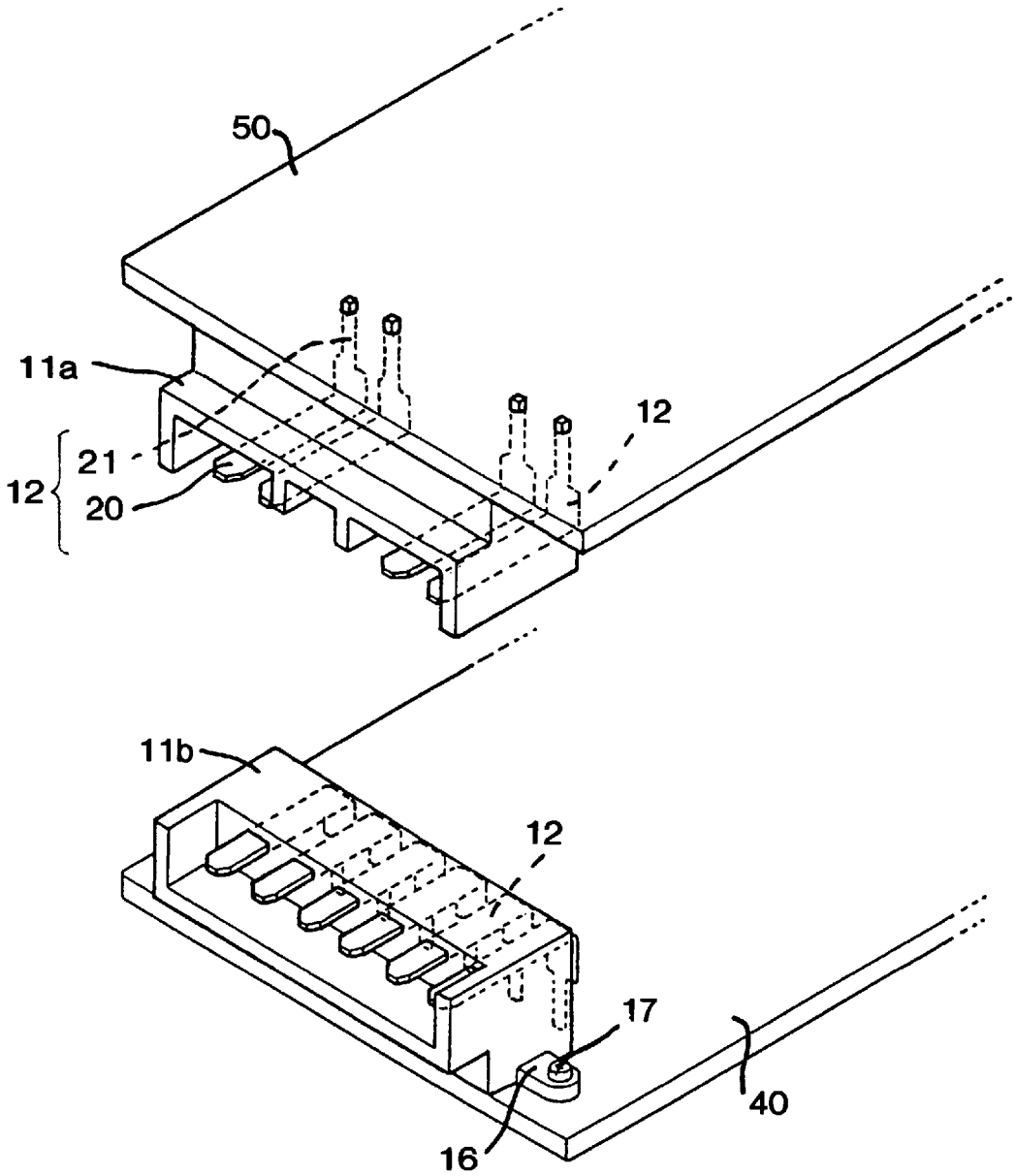
FIG. 9 is a perspective view of a fifth embodiment of the present invention in a semi-assembled state.

A fifth embodiment of the invention is described with reference to FIG. 9.

In the fifth embodiment the housing of the connector is subdivided in two housing parts 11*a* and 11*b* being in particular similar in construction. The housing parts 11*a* and 11*b* are each provided with one or more terminal fittings 12 being similar in construction to those of the first embodiment (FIG. 1). Each terminal fitting 12 has a known L-shaped structure including a tab 20 extending toward the opening of the hood, which is formed when the two housing parts are joined, and a board connection portion 21 extending towards the respective board 50 and 40 from the rear end of the tab 20 behind the housing parts 11*a* and 11*b*. The tab 20 is engageable with a female terminal fitting (not shown) of a mating connector.

The first and second housing part 11*a* and 11*b* may be fixedly connected, in particular screwed by means of bolts or screws 17 to the respective boards 50 and 40 by means of mount portions 16 being integrally or unitarily provided on their lateral surfaces.

The first and second housing part 11*a* and 11*b* joined together may be connected with a single mating connector (not shown) with female terminal fittings.

What is claimed is:

1. A connector for a main circuit board (40) and an auxiliary circuit board (50), comprising:

at least one main board side terminal (12) having a first portion (21) connected with circuitry on the main circuit board (40) and a second portion (20) extending from the main circuit board (40);

a holding plate (15) having a first surface engaged against the auxiliary circuit board (50) and an opposed second surface, at least one positioning hole (36) extending through said holding plate (15) between the first and second surfaces thereof;

at least one auxiliary board side terminal (14) having a mount portion (34) extending through the positioning hole (36) and at least to the first surface of the holding plate (15) for connection with circuitry on the auxiliary circuit board (50), said auxiliary board side terminal (14) further having a connection portion (33) projecting from the second surface of the holding plate (15);

a housing (11) mounted to the main circuit board (40) and detachably disposed adjacent said second surface of said holding plate (15), said housing (11) being formed with at least one cavity (23) for receiving the connection portion (33) of the auxiliary board side terminal (14), at least one mount hole (19) for receiving the second portion (20) of the main board side terminal (12) and a mating portion (18) for mating with another connector; and at least one housing side terminal (13) secured to the housing (11), said housing side terminal (13) having a mating portion (25) in proximity to the mating portion (18) of the housing (11) for mating with the other connector, said housing side terminal (13) further comprising a connection portion (26) aligned with said cavity (23) of said housing (11) and detachably connected to said connection portion (33) of said auxiliary board side terminal (14).

2. A connector according to claim 1, wherein the main board side terminal (12) is fixedly connected with the main circuit board (40).

3. A connector according to claim 1, wherein at least one of the housing side terminal (13) and the main board side terminal (12) has the housing (11) integrally formed thereabout.

4. A connector according to claim 1, wherein the connection portion (33) of the auxiliary board side terminal (14) is substantially planar, and wherein the connection portion (26) of said housing said terminal (13) includes at least one slot (31) dimensioned and configured for receiving said planar connection portion (33) of said auxiliary board side terminal (14).

5. A connector according to claim 4, wherein the holding plate (15) comprises at least one positioning slot (35) for holding the substantially planar connection portion (33) of the auxiliary board side terminal (14).

6. A connector according to claim 4, wherein the connection portion (26) of the housing side terminal (13) comprises front and rear plates (27, 28) disposed in spaced parallel relationship to one another, said plates (27, 28) being formed respectively to include slots (31) aligned to receive said planar connection portion (33) of said auxiliary board side terminal (14).

7. A connector according to claim 6, wherein each said slot (31) is substantially V-shaped for guiding said planar connection portion (13) of said auxiliary board side terminal (14) into said slot (31).

8. A connector according to claim 1, comprising at least one housing side main terminal (13) disposed in the housing (11) and releasably engaging the second portion (20) of said main board side terminal (12).

9. A connector according to claim 1, wherein said auxiliary circuit board (50) includes a plurality of through holes (51) at a specified spacing relative to one another, said at least one positioning hole (36) in said holding plate (15) defining a plurality of positioning holes (36) disposed for alignment with the through holes (51) in the auxiliary circuit board (50) when the first surface of the holding plate (15) is disposed adjacent said auxiliary circuit board (50), and wherein said at least one auxiliary board side terminal (14) comprises a plurality of said board side terminals (14) having respective mount portions (34) mounted in the positioning holes (36) of the holding plate and extending into the through holes (51) of the auxiliary circuit board (50).

10. A connector according to claim 9, wherein said at least one cavity (23) in said housing (11) comprises a plurality of said cavities (23) disposed respectively for receiving the connection portions (33) of the respective auxiliary board side terminals (14) and wherein said at least one housing side terminal (13) comprises a plurality of said housing side terminals (13).

* * * * *